US011731674B2

(12) United States Patent
Su et al.

(10) Patent No.: US 11,731,674 B2
(45) Date of Patent: Aug. 22, 2023

(54) OPERATION ADJUSTMENT METHOD AND SYSTEM FOR METRO TRAINS IN DELAY SCENARIO

(71) Applicant: BEIJING JIAOTONG UNIVERSITY, Beijing (CN)

(72) Inventors: Shuai Su, Beijing (CN); Boyi Su, Beijing (CN)

(73) Assignee: BEIJING JIAOTONG UNIVERSITY, Beijing (CN)

( * ) Notice: Subject to any disclaimer, the term of this patent is extended or adjusted under 35 U.S.C. 154(b) by 0 days.

(21) Appl. No.: 17/622,014

(22) PCT Filed: Dec. 1, 2020

(86) PCT No.: PCT/CN2020/133085
§ 371 (c)(1),
(2) Date: Dec. 22, 2021

(87) PCT Pub. No.: WO2022/088375
PCT Pub. Date: May 5, 2022

(65) Prior Publication Data

US 2023/0166782 A1 Jun. 1, 2023

(30) Foreign Application Priority Data

Oct. 27, 2020 (CN) ..... 202011159755.8

(51) Int. Cl.
*B61L 27/00* (2022.01)
*B61L 27/10* (2022.01)

(52) U.S. Cl.
CPC ..... *B61L 27/10* (2022.01)

(58) Field of Classification Search
CPC ..... B61L 27/10
See application file for complete search history.

(56) References Cited

U.S. PATENT DOCUMENTS 6,980,894 B1 12/2005 Gordon et al.
2015/0269491 A1* 9/2015 Tripathi ..... G08G 1/0129 706/46

(Continued)

FOREIGN PATENT DOCUMENTS

CN 106741019 A * 5/2017 ..... B61L 27/0011
CN 106741019 A 5/2017

(Continued)

OTHER PUBLICATIONS

International Search Report for Corresponding PCT Application PCT/CN2020/133085 dated Jul. 26, 2021.

(Continued)

*Primary Examiner* — Adam D Tissot
(74) *Attorney, Agent, or Firm* — Gregory D. Degrazia; Miller, Canfield, Paddock and Stone

(57) ABSTRACT

The present disclosure provides an operation adjustment method and system for metro trains in a delay scenario. The method includes: acquiring basic parameters, current delay information and current online train information in a metro system; determining a detaining position of a departing train and an operation strategy of a waiting train according to the acquired; determining a next state of a running train according to the detaining position, the operation strategy, and the acquired; and optimally configuring an available rolling stock resource of the metro system according to the next state of the running train and operation data. The present disclosure can automatically adjust the operation diagram according to the delay information and reasonably change the operation plan of the rolling stock, so as to reduce influences of the delay on passengers and improve the actual fulfillment rate of the operation diagram.

5 Claims, 2 Drawing Sheets

(56) References Cited

U.S. PATENT DOCUMENTS

| | | | | |
|---|---|---|---|---|
| 2016/0039438 | A1* | 2/2016 | Miyajima | B61L 27/40<br>701/19 |
| 2017/0190340 | A1* | 7/2017 | Jung | B61L 3/008 |

FOREIGN PATENT DOCUMENTS

| | | | |
|---|---|---|---|
| CN | 110775109 | A | 2/2020 |
| CN | 110979407 | A | 4/2020 |
| CN | 111768074 | A | 10/2020 |

OTHER PUBLICATIONS

International Search Report for PCT Application PCT/CN2020/133085 (English Translation) dated Jul. 26, 2021.
First Office Action for corresponding CN application 202011159755.8.

* cited by examiner

OPERATION ADJUSTMENT METHOD AND SYSTEM FOR METRO TRAINS IN DELAY SCENARIO

CROSS REFERENCE TO RELATED APPLICATION

The present application claims priority to International Patent Application No. PCT/CN2020/133085 filed on Dec. 1, 2020 which claims priority to Chinese Patent Application No. 2020111597558 filed on Oct. 27, 2020 and entitled "OPERATION ADJUSTMENT METHOD AND SYSTEM FOR METRO TRAINS IN DELAY SCENARIO", which is incorporated herein by reference in its entirety.

TECHNICAL FIELD

The present disclosure relates to the field of train operation organization and control, and in particular, to an operation adjustment method and system for metro trains in a delay scenario.

BACKGROUND ART

As a traffic mode with high capacity, low energy consumption and high punctuality rate, the metro can relieve the ground traffic pressure, improve the urban transportation and play a vital role in urban economic and social development. However, the metro system is inevitably disturbed by various factors during operation to cause faults or emergencies, which lead to delay of trains, deviation from the planned operation diagram, and so on. Particularly in peak hours, the delay of the trains spreads quickly, such that multiple trains in the system arrive late, the normal operation is disturbed, and the quality of service (QoS) is reduced.

In case of the faults or emergencies during operation, the metro dispatcher adjusts the trains based on the operation diagram with comprehensive consideration of topological line structures and available rolling stock resources, so as to reduce influences of the delay on passengers. In recent years, with the gradually increasing demand of passengers, the metro trains are operated at a higher frequency, and the headway between the trains also becomes smaller. In the face of delay of multiple trains in the peak hours, the metro dispatcher is greatly pressured for the train operation organization and management and is highly demanded in terms of the experience and strain capacities. Hence in order to reduce the influences caused by train delays, the intelligent operation organization in faults or emergencies and rapid formulation of reasonable operation adjustment strategies have been one of key research directions of the metro system.

Presently, the train operation is still adjusted manually. The metro dispatcher makes decisions based on the acquired delay information, and sends commands such as detaining, coming out of and back to the depot for each train via telephone. The above processes are not implemented automatically and intelligently, and particularly with the increase of the traffic flow in peak hours, the metro dispatcher needs to adjust multiple trains one by one within a short time, which greatly increases labor intensity and working pressure. Moreover, the work of making decisions and sending commands may lead to untimely operations and further expand the adverse effects of the faults or emergencies.

While adjusting the train operation, the dispatcher not only need to makes full use of available lines and rolling stock resource in the metro system, but also considers running time constraints, such as the time of turning back or leaving the depot. According to conventional adjustment methods, the dispatcher should make a quick response to the faults or emergencies. Meanwhile, the train operation adjustment involves a large number of decisions, all of which cannot ensure a result to be reasonable and optimal.

Due to individual differences in the existing manual adjustment, different dispatchers yield different efficiencies and results to deal with the same situation. In addition, the delay of the trains is arising from a variety of faults or emergencies, and the actual site condition is complicated, so the dispatcher is highly demanded in the working experience and strain capacity. Particularly for a newcomer who cannot grasp the operation of the metro system overall, scenarios such as the insufficient fulfillment rate of the operation diagram, and serious delay of the trains occur during the index statistic stage.

To sum up, the existing adjustment methods have the following defects:

1. As the dispatcher adjusts the train operation diagram manually according to the working experience and site condition, and sends the adjustment result via the dispatching telephones, the working pressure is large and the disposal process is complicated.
2. During the adjustment of the operation diagram, various influencing factors are considered comprehensively, and a large number of decisions are involved particularly in the peak hours, all of which cannot ensure the result to be reasonable and optimal.
3. Due to the individual differences in manually adjusting the operation diagram, different dispatchers yield different efficiencies and results.
4. The delay of the trains is arising from a variety of faults or emergencies, and the actual site condition is complicated, so the dispatcher is highly demanded in the working experience and strain capacity.

SUMMARY

An objective of the present disclosure is to provide an operation adjustment method and system for metro trains in a delay scenario. The present disclosure can automatically adjust the operation diagram according to the delay information and reasonably change the operation plan of the rolling stock, so as to reduce influences of the delay on passengers and improve the actual fulfillment rate of the operation diagram.

To implement the above objective, the present disclosure provides the following solutions:

An operation adjustment method for metro trains in a delay scenario includes:

acquiring basic parameters, current delay information and current online train information in a metro system, where the basic parameters include: a topological line structure and operation data; the topological line structure includes: a line velocity limit, a slope, a position and a siding type of each station, and a position and a switch track siding type of a depot; the operation data includes: a planned operation diagram, a minimum headway, a position of each backup train and the number of backup trains, and required time for trains to leave the depot and turn back; the delay information includes: time, a position and duration of delay; and the online operation train information includes: train services, velocities and positions of all trains upon the occurrence of the delay;

determining a detaining position of a departing train and an operation strategy of a waiting train according to the basic parameters, the current delay information and the current online train information, where the operation strategy is a normal departure operation of the waiting train or a departure cancellation operation of the waiting train;

determining a next state of a running train according to the detaining position of the departing train, the operation strategy of the waiting train, the basic parameters, the current delay information and the current online train information; and optimally configuring an available rolling stock resource of the metro system according to the next state of the running train and the operation data.

Optionally, before acquiring the basic parameters, the current delay information and the current online train information in a metro system, the method may further include:

configuring the basic parameters according to an actual route and an actual operation condition.

Optionally, the determining the detaining position of the departing train and the operation strategy of the waiting train, according to the basic parameters, the current delay information and the current online train information, may specifically include:

determining an affected train set according to the basic parameters, the current delay information and the current online train information, where the affected train set includes: a departing train set and a waiting train set;

sequentially traversing the departing train set according to train service numbers in an ascending order, and determining whether a free parking point is present between a current train in the departing train set and a delay occurrence position;

detaining, if yes, the current train at the free parking point nearest to the delay occurrence position; or otherwise, detaining the current train at a current position;

traversing all decision-making combinations in the waiting train set, and calculating a target value under a current decision-making combination, where the decision-making combination is a combination of the departure operation and the departure cancellation operation;

determining whether the target value under the current decision-making combination is a current minimum target value;

taking, if the target value under the current decision-making combination is the current minimum target value, the current decision-making combination as the operation strategy of the waiting train; and determining whether all decision-making combinations are traversed, and outputting the operation strategy if yes; or otherwise, replacing the current decision-making combination as a next untraversed decision-making combination, and going back to the step of traversing all decision-making combinations in the waiting train set, and calculating the target value under the current decision-making combination; and determining, if the target value under the current decision-making combination is not the current minimum target value, whether all decision-making combinations are traversed, and outputting the current decision-making combination if yes; or otherwise, replacing the current decision-making combination as a next untraversed decision-making combination, and going back to the step of traversing all decision-making combinations in the waiting train set, and calculating the target value under the current decision-making combination.

Optionally, the determining the next state of the running train, according to the detaining position of the departing train, the operation strategy of the waiting train, the basic parameters, the current delay information and the current online train information, may specifically include:

determining, upon repair of normal operation, all online running train sets and positions and states of all trains therein according to the siding type, the detaining position of the departing train and the operation strategy of the waiting train;

determining, if a train k normally runs upon the repair of the normal operation, time of arrival at a destination station according to the planned operation diagram;

calculating, if the train k is detained upon the repair of the normal operation, time when the train k is repaired for operation according to the minimum headway; and determining, according to the time when the train k is repaired for operation, time of arrival at the destination station.

Optionally, the optimally configuring the available rolling stock resource of the metro system, according to the next state of the running train and the operation data may specifically include:

determining, according to the planned operation diagram, a turn-back train service set of all affected trains in the planned operation diagram;

acquiring an available backup rolling stock set of the depot according to the turn-back train service set and the operation data;

determining an available online rolling stock set according to the operation data and the next state of the running train;

determining whether the available backup rolling stock set of the depot and the available online rolling stock set include a free train in the same direction; executing a planned train service if yes; or otherwise, determining whether the available backup rolling stock set of the depot and the available online rolling stock set include a free train in the opposite direction, where, the free train in the opposite direction is a rolling stock which meets departure time of the planned train service after turning back midway at a turn-back station as a temporary passenger train; if yes, executing the planned train service after the temporary passenger train turns back; or otherwise, canceling the planned train service.

Optionally, after the determining whether the available backup rolling stock set of the depot and the available online rolling stock set include the free train in the same direction; executing the planned train service if yes; or otherwise, determining whether the available backup rolling stock set of the depot and the available online rolling stock set include the free train in the opposite direction, where, the free train in the opposite direction is a rolling stock which meets departure time of the planned train service after turning back midway at the turn-back station as the temporary passenger train; if yes, executing the planned train service after the temporary passenger train turns back; or otherwise, canceling the planned train service, the method may further include:

determining, after traversing all train services in the turn-back train service set and allocating an executable rolling stock, whether the available online rolling stock set has a remaining rolling stock resource; and allocating the remaining rolling stock resource to a preset storage place in the metro system if yes.

An operation adjustment system for metro trains in a delay scenario includes:

a data acquisition module, configured to acquire basic parameters, current delay information and current online train information in a metro system, where the basic parameters include: a topological line structure and operation data;

the topological line structure includes: a line velocity limit, a slope, a position and a siding type of each station, and a position and a switch track siding type of a depot; the operation data includes: a planned operation diagram, a minimum headway, a position of each backup train and the number of backup trains, and required time for trains to leave the depot and turn back; the delay information includes: time, a position and duration of delay; and the online operation train information includes: train services, velocities and positions of all trains upon the occurrence of the delay;

a strategy determination module, configured to determine a detaining position of a departing train and an operation strategy of a waiting train according to the basic parameters, the current delay information and the current online train information, where the operation strategy is a normal departure operation of the waiting train or a departure cancellation operation of the waiting train;

a state prediction module, configured to determine a next state of a running train according to the detaining position of the departing train, the operation strategy of the waiting train, the basic parameters, the current delay information and the current online train information; and an available rolling stock resource configuration module of the metro system, configured to optimally configure an available rolling stock resource of the metro system according to the next state of the running train and the operation data.

Optionally, the system may further include:

a basic parameter configuration module, configured to configure the basic parameters according to an actual route and an actual operation condition.

Based on specific embodiments provided in the present disclosure, the present disclosure discloses the following technical effects:

The operation adjustment method and system for the metro trains in the delay scenario provided by the present disclosure determine the detaining position of the departing train and the operation strategy of the waiting train according to the basic parameters, the current delay information and the current online train information; determine the next state of the running train according to the detaining position of the departing train, the operation strategy of the waiting train, the basic parameters, the current delay information and the current online train information; and optimally configure the available rolling stock resource of the metro system according to the next state of the running train and the operation data. The present disclosure replaces the manual adjustment of the dispatcher on the operation diagram in the delay scenario, simplifies the disposal process and reduces the working pressure of the dispatcher. The present disclosure plans the available rolling stock and line resources overall, and adjusts the metro train reasonably by turning back the train, operating the temporary passenger train, making use of the backup train and the like, thereby maintaining a service level of the metro system in the delay scenario and reducing influences of the delay. The present disclosure eliminates the individual differences of the existing manual adjustment, improves the adjustment efficiency of the operation diagram, and avoids problems such as the insufficient fulfillment rate of the operation diagram due to insufficient experience of the dispatcher.

BRIEF DESCRIPTION OF THE DRAWINGS

The present disclosure will be described in detail with reference to the accompanying drawings.

DETAILED DESCRIPTION OF THE EMBODIMENTS

The technical solutions of the embodiments of the present disclosure are clearly and completely described below with reference to the accompanying drawings. Apparently, the described embodiments are merely a part rather than all of the embodiments of the present disclosure. All other embodiments obtained by a person of ordinary skill in the art based on the embodiments of the present disclosure without creative efforts shall fall within the protection scope of the present disclosure.

An objective of the present disclosure is to provide an operation adjustment method and system for metro trains in a delay scenario. The present disclosure can automatically adjust the operation diagram according to the delay information and reasonably change the operation plan of the rolling stock, so as to reduce influences of the delay on passengers and improve the actual fulfillment rate of the operation diagram.

To make the above-mentioned objectives, features, and advantages of the present disclosure clearer and more comprehensible, the present disclosure will be further described in detail below with reference to the accompanying drawings and the specific implementation.

Figure 1:
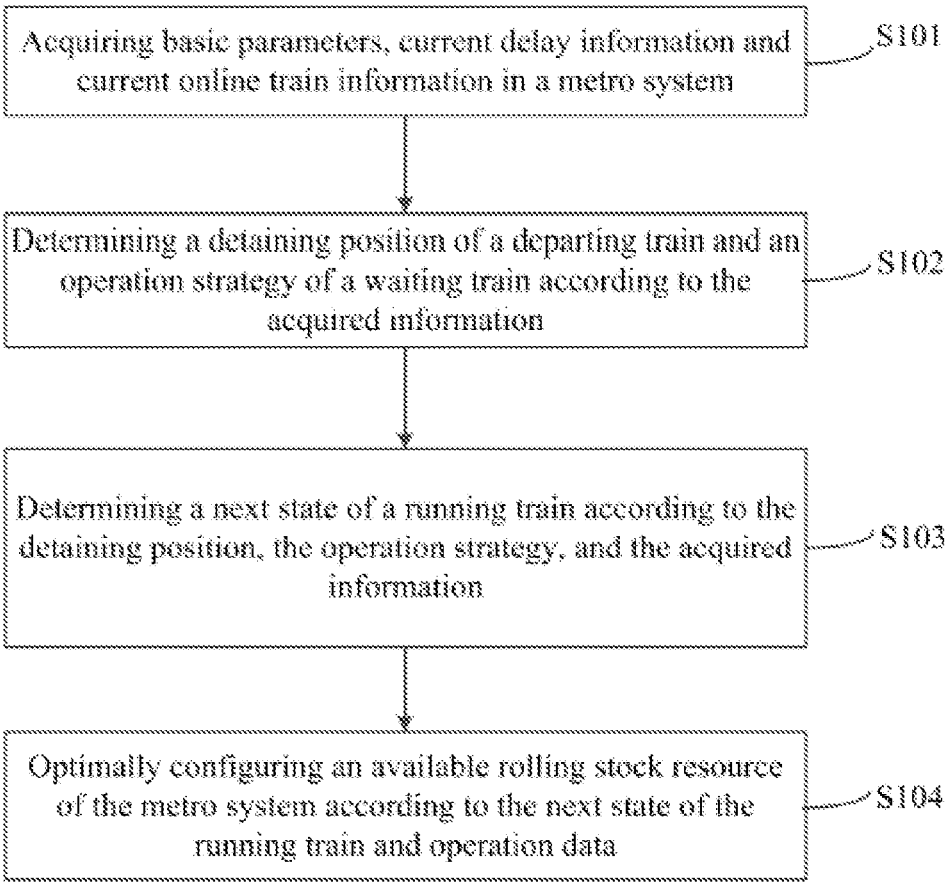
FIG. 1 is a flow chart of an operation adjustment method for metro trains in a delay scenario according to the present disclosure.

FIG. 1 is a flow chart of an operation adjustment method for metro trains in a delay scenario according to the present disclosure. As shown in FIG. 1, the operation adjustment method for metro trains in the delay scenario provided by the present disclosure includes the following steps S101-S104.

S101: Basic parameters, current delay information and current online train information in a metro system are acquired, where the basic parameters include: a topological line structure and operation data; the topological line structure includes: a line velocity limit, a slope, a position and a siding type of each station, and a position and a switch track siding type of a depot; the operation data includes: a planned operation diagram, a minimum headway, a position of each backup train and the number of backup trains, and required time for trains to leave the depot and turn back; the delay information includes: time, a position and duration of delay; and the online operation train information includes: train services, velocities and positions of all trains upon the occurrence of the delay.

$$\text{Siding type } \xi_n^{sta} = \begin{cases} 0, \text{ if the station } n \text{ does not provide the turn-back line} \\ 1, \text{ if the station } n \text{ provides the turn-back line} \end{cases}$$

The planned operation diagram includes a planned train service set $\mathcal{K}$, and departure time $d_{k,n}^{plan}$, arrival time $a_{k,n}^{plan}$ and a moving direction $D_k$ at the station n.

$$D_k = \begin{cases} 1, \text{ if the train } k \text{ is in the down direction} \\ 2, \text{ if the train } k \text{ is in the up direction} \end{cases}.$$

Before S101, the method further includes:

Configuring the basic parameters according to an actual route and an actual operation condition.

S102: A detaining position of a departing train and an operation strategy of a waiting train are determined according to the basic parameters, the current delay information and the current online train information, where the operation strategy is a normal departure operation of the waiting train or a departure cancellation operation of the waiting train.

S102 specifically includes:

Determining an affected train set according to the basic parameters, the current delay information and the current online train information, where the affected train set includes: a departing train set $\mathcal{K}_{dep}$ and a waiting train set $\mathcal{K}_{wait}$;

Sequentially traversing the departing train set according to train service numbers in an ascending order, and determining whether a free parking point is present between a current train in the departing train set and a delay occurrence position;

Detaining, if yes, the current train at a free parking point nearest to the delay occurrence position; or otherwise, detaining the current train at a current position;

Traversing all decision-making combinations in the waiting train set, and calculating a target value under a current decision-making combination, where the decision-making combination is a combination of the departure operation and the departure cancellation operation. The target value is $Z=\omega_1 Z_1+\omega_2 Z_2=\Sigma_{k\in \mathcal{K}_{wait}}\omega Z_{1,k}+\omega_2 Z_{2,k}$, where, $Z_{1,k}$ is delay time of the train k under the current decision-making combination, and $Z_{2,k}$ is cancellation condition of the train k under the current decision-making combination, where $$Z_{1,k}=\begin{cases} t_{delay}, \text{ if the train } k \text{ departs normally} \\ 0, \text{ if the train } k \text{ is canceled for departure} \end{cases}$$

$$Z_{2,k}=\begin{cases} 0, \text{ if the train } k \text{ departs normally} \\ 1, \text{ if the train } k \text{ is canceled for departure} \end{cases},$$

Where, $t_{delay}$ represents delay time when the train k arrives at the destination station after departing normally; with comparisons for finding the decision-making combination corresponding to the minimum target value, the normal departure or departure cancellation operation of the waiting train may be obtained, thereby forming the operation strategy in the delay;

Determining whether the target value under the current decision-making combination is a current minimum target value;

Taking, if the target value under the current decision-making combination is the current minimum target value, the current decision-making combination as the operation strategy of the waiting train; determining whether all decision-making combinations are traversed; and outputting the operation strategy if yes; or otherwise, replacing the current decision-making combination as a next untraversed decision-making combination, and going back to the step of traversing all decision-making combinations in the waiting train set and calculating the target value under the current decision-making combination; and Determining, if the target value of the current decision-making combination is not the current minimum target value, whether all decision-making combinations are traversed, and outputting the current decision-making combination if yes; or otherwise, replacing the current decision-making combination as a next untraversed decision-making combination, and going back to the step of traversing all decision-making combinations in the waiting train set and calculating the target value under the current decision-making combination.

S103: A next state of a running train is determined according to the detaining position of the departing train, the operation strategy of the waiting train, the basic parameters, the current delay information and the current online train information.

S103 specifically includes:

Determining, upon repair of normal operation, all online running train sets $\mathcal{K}_{run}$ and positions $S_k^{tra}$ and states $\delta_k^{tra}$ of all trains therein according to the siding type, the detaining position of the departing train and the operation strategy of the waiting train;

$$\delta_k^{tra}=\begin{cases} 0, \text{ if the train } k \text{ runs normally} \\ 1, \text{ if the train } k \text{ is detained} \end{cases};$$

Determining, if the train k normally runs upon the repair of the normal operation, time $a_k^{pre}$ of arrival at a destination station according to the planned operation diagram;

$$a_k^{pre}=\begin{cases} a_{k,1}^{plan}, \text{ if } D_k=1 \text{ and } \delta_k^{tra}=0 \\ a_{k,N}^{plan}, \text{ else if } D_k=2 \text{ and } \delta_k^{tra}=0 \end{cases},$$

Where, $a_k^{pre}$ is time when the train k is predicted to arrive at the destination station, and $a_k^{plan}$ is planned time;

Calculating, if the train k is detained upon the repair of the normal operation, time $T_k^{depart}$ when the train k is repaired for operation according to the minimum headway, $$T_k^{depart}=T^*+(k-k^*)h_{min},$$

Where, k* is the train service number of the first affected train, and T* is time when the normal operation is repaired, and $T^*=T_{fault}+t_{repair}$.

When the train is detained at the station $n_k$, the time of arrival at the station n is a sum of the time when the normal operation is repaired, the subsequent inter-station running time and the station dwell time, which is indicated as:

$$a_{k,n}^{pre}=\begin{cases} T_k^{depart}+\sum_{n_k+1}^{n} q_{k,n}+\sum_{n_k+3}^{n-1} s_{k,n}, \text{ if } D_k=2 \\ T_k^{depart}+\sum_{n}^{n_k-1} q_{k,n}+\sum_{n-1}^{n_k-1} s_{k,n}, \text{ else if } D_k=1 \end{cases},$$

Where, $q_{k,n}$ represents inter-station running time of the train for arrival at the station n, and may be obtained by subtracting planned time when the train k departs the previous station from planned time when the train k arrives at the station n, which is indicated as:

$$q_{k,n}=\begin{cases} a_{k,n}^{plan}-d_{k,n-1}^{plan}, \text{ if } D_k=2 \\ a_{k,n}^{plan}-d_{k,n+1}^{plan}, \text{ else if } D_k=1 \end{cases},$$

Where, $s_{k,n}$ represents the dwell time of the train at the station n and is determined by the number of waiting passengers $P_n^{wait}$ at the station and a boarding rate $\lambda$ of the passengers, which is written as:

$$s_{k,n} = \frac{P_n^{wait}}{\lambda}.$$

When the train is detained in an interval toward the station $n_k$, the time of arrival at the station $n_k$ is calculated as follows with the shortest running time calculation model:

(1) From the destination of the interval (the entry velocity is 0), the operation curve (referred to as the maximum braking curve) $v_i^b(s)$ corresponding to the maximum braking force of the train in each velocity-limiting section is drawn from the entry velocity of the next velocity-limiting section, thereby obtaining the moving trajectory of the train and the entry velocity $v_i^{entry}$ in the current velocity-limiting section. If there is an intersection between the maximum braking curve and the velocity limit, $v_i^{entry}$ is the same as the velocity limit; and if there is no intersection, the $v_i^{entry}$ is the same as the entry velocity of the maximum braking curve, which is indicated as:

$$v_i^{entry} = \begin{cases} v_i^{limit}, \text{ if } v_i^{limit} \le v_i^b(s_i) \\ v_i^b(s_i), \text{ otherwise} \end{cases}.$$

(2) From the current velocity point of the train, the operation curve (referred to as the maximum tractive curve) $v_i^h(s)$ corresponding to the maximum tractive force of the train in each velocity-limiting section is drawn with the smaller of the velocity limit $v_i^{limit}$ and the entry velocity $v_i^{entry}$ in the current section, i.e.:

$$v_i^h(s_i) = \begin{cases} v_i^{limit}, \text{ if } v_i^{limit} \le v_i^{entry} \\ v_i^{entry}, \text{ otherwise} \end{cases}.$$

(3) The minimum velocity at each position is obtained to be connected as the operation curve of the train, i.e.:

$$v_i(s)=\min\{v_i^h(s), v_i^b(s), v_i^{limit}\}.$$

Time of arrival at the forward station:

$$t_{run} = \Sigma_i \int_{s_i}^{s_{i+1}} \frac{1}{v_i(s)} ds.$$

The time when the train k arrives at the station n may be indicated as:

$$a_{k,n}^{pre} = \begin{cases} T_k^{depart} + t_{run} + \sum_{n_k+1}^{n} q_{k,n} + \sum_{n_k}^{n-1} s_{k,n}, \text{ if } D_k = 2 \\ T_k^{depart} + t_{run} + \sum_{n}^{n_k-1} q_{k,n} + \sum_{n-1}^{n_k} s_{k,n}, \text{ else if } D_k = 1 \end{cases}.$$

The step S103 further includes determining, according to the time when the train k is repaired for operation, time of arrival at the destination station.

The above time is determined according to the time when the train k is repaired for operation, position and velocity information of each train upon the repair of the normal operation, the siding type of the turn-back station, the minimum headway, the remaining inter-station running time and the station dwell time.

S104: An available rolling stock resource of the metro system is optimally configured according to the next state of the running train and the operation data. The planned train service is operated by turning back the train, making use of the backup train and the like, to ensure the fulfillment rate of the operation diagram as much as possible. The available rolling stock resource includes a rolling stock running on a main track and a rolling stock backed up in the depot. While constraints on the required time for trains to leave the depot and turn back and the number of backup trains are met, the planned train service may be operated in three ways, i.e., the train turning back normally at the destination station, the train turning back midway at the intermediate station, or the backup train being used for operation.

S104 specifically includes:

Determining, according to the planned operation diagram, a turn-back train service set $\mathcal{K}_{affect}$ of all affected trains in the planned operation diagram;

Acquiring an available backup rolling stock set M of the depot according to the turn-back train service set and the operation data;

Determining an available online rolling stock set $R_{free}$ according to the operation data and the next state of the running train; and Determining whether the available backup rolling stock set of the depot and the available online rolling stock set include a free train in the same direction; and executing a planned train service if yes; or otherwise, determining whether the available backup rolling stock set of the depot and the available online rolling stock set include a free train in the opposite direction, where, the free train in the opposite direction is a rolling stock which meets departure time of the planned train service after turning back midway at the turn-back station as a temporary passenger train; if yes, executing the planned train service after the temporary passenger train turns back; or otherwise, canceling the planned train service.

1) While the shortest turn-back time $t_{turn}$ and the planned departure time are met, whether the set $R_{free}$ includes the free train in the same direction is indicated as:

$$\eta = \begin{cases} 1, \text{ if } \left(\exists\, d_{k,n}^{plan} - a_r^{free} \ge t_{turn}, \forall\, r \in R_{free}\right) \text{ and } \xi_n^{sta} = 1 \\ 0, \text{ otherwise} \end{cases}.$$

Where, $a_r^{free}$ represents start time when the rolling stock r is free.

(2) While the online time $t_{online}$ of the backup train and the planned departure time are met, whether the set M includes the free train in the same direction is indicated as:

$$\eta = \begin{cases} 1, \text{ if } \exists\, d_{k,1}^{plan} - a_m^{free} \ge t_{online}, \forall\, m \in M \\ 0, \text{ otherwise} \end{cases}.$$

If $\eta=1$, i.e., the free train in the same direction is included, the planned train service is executed by the free rolling stock; or otherwise, whether the set $R_{free}$ or M includes the free train in the opposite direction which meets the departure time of the planned train service after turning back midway at the turn-back station as the temporary passenger train, is continuously determined, with the result denoted by $\gamma$ and the Eq. denoted as:

$$\gamma = \begin{cases} 1, \text{ if } \left(\exists\, d_{k,n}^{plan} - a_{r,n}^{arrive} \geq t_{turn}, \forall\, r \in R_{free} \cup M\right) \text{ and } \xi_n^{sta} = 1 \\ 0, \text{ otherwise} \end{cases}.$$

Where, $a_{r,n}^{arrive}$ represents time when the free rolling stock r arrives at the station n as the temporary passenger train.

If $\gamma=1$, i.e., the free train in the opposite direction is included, the train service is executed after the free rolling stock turns back as the temporary passenger train; or otherwise, the train service is canceled, and the turn-back train service is added to the set $\mathcal{K}_{affect}$.

After the step of determining whether the available backup rolling stock set of the depot and the available online rolling stock set include the free train in the same direction; and executing the planned train service if yes; or otherwise, determining whether the available backup rolling stock set of the depot and the available online rolling stock set include the free train in the opposite direction, where, the free train in the opposite direction is a rolling stock which meets the departure time of the planned train service after turning back midway at the turn-back station as the temporary passenger train; if yes, turning the temporary passenger train back to execute the planned train service; or otherwise, canceling the planned train service, the method further includes:

Determining, after traversing all train services in the turn-back train service set and allocating an executable rolling stock, whether the available online rolling stock set has a remaining rolling stock resource; and Allocating the remaining rolling stock resource to a preset storage place in the metro system if yes.

Figure 2:
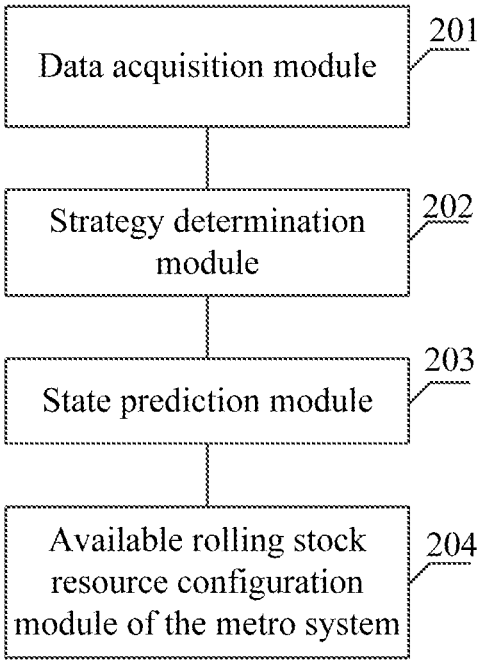
FIG. 2 is a schematic structural view of an operation adjustment system for metro trains in a delay scenario according to the present disclosure.

FIG. 2 is a schematic structural view of an operation adjustment system for metro trains in a delay scenario according to the present disclosure. As shown in FIG. 2, the operation adjustment system for the metro trains in the delay scenario provided by the present disclosure includes:

a data acquisition module 201, configured to acquire basic parameters, current delay information and current online train information in a metro system, where the basic parameters include: a topological line structure and operation data; the topological line structure includes: a line velocity limit, a slope, a position and a siding type of each station, and a position and a switch track siding type of each depot; the operation data includes: a planned operation diagram, a minimum headway, a position of each backup train and the number of backup trains, and required time for trains to leave the depot and turn back; the delay information includes: time, a position and duration of delay; and the online operation train information includes: train services, velocities and positions of all trains upon the occurrence of the delay;

a strategy determination module 202, configured to determine a detaining position of a departing train and an operation strategy of a waiting train according to the basic parameters, the current delay information and the current online train information, where the operation strategy is a normal departure operation of the waiting train or a departure cancellation operation of the waiting train;

a state prediction module 203, configured to determine a next state of a running train according to the detaining position of the departing train, the operation strategy of the waiting train, the basic parameters, the current delay information and the current online train information; and an available rolling stock resource configuration module 204 of the metro system, configured to optimally configure an available rolling stock resource of the metro system according to the next state of the running train and the operation data.

The operation adjustment system for the metro trains in the delay scenario further includes:

a basic parameter configuration module, configured to configure the basic parameters according to an actual route and an actual operation condition.

The operation adjustment method and system for the metro trains in the delay scenario have the following advantages:

1. The present disclosure replaces the manual adjustment of the dispatcher on the operation diagram in the delay scenario with the intelligent method, simplifies the disposal process and reduces the working pressure of the dispatcher.

2. The present disclosure plans the available rolling stock and line resources overall, and adjusts metro train reasonably by turning back the train, operating the temporary passenger train service, making use of the backup train and the like, thereby maintaining a service level of the metro system in the delay scenario, and reducing influences of the delay.

3. The present disclosure eliminates the individual differences of the existing manual adjustment, improves the adjustment efficiency of the operation diagram, and avoids problems such as the insufficient fulfillment rate of the operation diagram due to insufficient experience of the dispatcher.

4. The operation adjustment method is applied to the delay of a single train or a plurality of trains as well as all faults or emergencies leading to the delay of the trains but not affecting spatio-temporal resources of lines and rolling stock resources, including the delay of the trains arising from signal faults, train faults, artificial factors, etc.

Each embodiment of the present specification is described in a progressive manner, each embodiment focuses on the difference from other embodiments, and the same and similar parts between the embodiments may refer to each other. Since the system disclosed in the embodiments corresponds to the method disclosed in the embodiments, the description is relatively simple, and reference can be made to the method description.

In this specification, several specific embodiments are used for illustration of the principles and implementations of the present disclosure. The description of the foregoing embodiments is used to help illustrate the method of the present disclosure and the core ideas thereof. In addition, those of ordinary skill in the art can make various modifications in terms of specific implementations and the scope of application in accordance with the ideas of the present disclosure. In conclusion, the content of this specification shall not be construed as a limitation to the present disclosure.

What is claimed is:

1. An operation adjustment method for metro trains in a delay scenario, comprising:

acquiring basic parameters, current delay information and current online train information in a metro system, wherein the basic parameters comprise: a topological line structure and operation data; the topological line structure comprises: a line velocity limit, a slope, a position and a siding type of each station, and a position and a switch track siding type of a depot; the operation data comprises: a planned operation diagram, a minimum headway, a position of each backup train and the number of backup trains, and required time for trains to leave the depot and turn back; the delay information comprises: time, a position and duration of delay; and the online operation train information comprises: train services, velocities and positions of all trains upon the occurrence of the delay;

determining a detaining position of a departing train and an operation strategy of a waiting train according to the basic parameters, the current delay information and the current online train information, wherein the operation strategy is a normal departure operation of the waiting train or a departure cancellation operation of the waiting train;

determining a next state of a running train according to the detaining position of the departing train, the operation strategy of the waiting train, the basic parameters, the current delay information and the current online train information;

configuring an available rolling stock resource of the metro system according to the next state of the running train and the operation data;

generating an adjusted operation diagram for the metro trains according to the available rolling stock resource;

transmitting the adjusted operation diagram to the metro trains for operation; and operating the metro trains according to the adjusted operation diagram, wherein determining the detaining position of the departing train and the operation strategy of the waiting train according to the basic parameters, the current delay information and the current online train information, comprises:

determining an affected train set according to the basic parameters, the current delay information and the current online train information, wherein the affected train set comprises a departing train set and a waiting train set;

sequentially traversing the departing train set according to train service numbers in an ascending order, and determining whether a free parking point is present between a current train in the departing train set and a delay occurrence position;

detaining the current train at the free parking point nearest to the delay occurrence position in a condition that the free parking point is present; or detaining the current train at a current position in a condition that the free parking point is not present;

traversing all decision-making combinations in the waiting train set, and calculating a target value under a current decision-making combination, wherein the decision-making combination is a combination of the departure operation and the departure cancellation operation;

determining whether the target value under the current decision-making combination is a current minimum target value;

taking the current decision-making combination as the operation strategy of the waiting train, in a condition that the target value under the current decision-making combination is the current minimum target value; and determining whether all decision-making combinations are traversed, and outputting the operation strategy in a condition that it is determined that all decision-making combinations are traversed; or in a condition that it is determined that all decision-making combinations are not traversed, replacing the current decision-making combination as a next untraversed decision-making combination, and going back to a step of traversing all decision-making combinations in the waiting train set, and calculating the target value under the current decision-making combination;

determining whether all decision-making combinations are traversed, in a condition that the target value under the current decision-making combination is not the current minimum target value, and outputting the current decision-making combination in a condition that it is determined that all decision-making combinations are traversed; or in a condition that it is determined that all decision-making combinations are not traversed, replacing the current decision-making combination as a next untraversed decision-making combination, and going back to the step of traversing all decision-making combinations in the waiting train set, and calculating the target value under the current decision-making combination.

2. The operation adjustment method for the metro trains in the delay scenario according to claim 1, before the acquiring the basic parameters, the current delay information and the current online train information in the metro system, further comprising:

configuring the basic parameters according to an actual route and an actual operation condition.

3. The operation adjustment method for the metro trains in the delay scenario according to claim 1, wherein the determining the next state of the running train according to the detaining position of the departing train, the operation strategy of the waiting train, the basic parameters, the current delay information and the current online train information comprises:

determining, upon repair of normal operation, all online running train sets, and positions and states of all trains therein according to the siding type, the detaining position of the departing train and the operation strategy of the waiting train;

determining, in a condition that a train k normally runs upon the repair of the normal operation, time of arrival at a destination station according to the planned operation diagram;

calculating, in a condition that the train k is detained upon the repair of the normal operation, time when the train k is repaired for operation according to the minimum headway; and determining, according to the time when the train k is repaired for operation, time of arrival at the destination station.

4. The operation adjustment method for the metro trains in the delay scenario according to claim 1, wherein the configuring the available rolling stock resource of the metro system according to the next state of the running train and the operation data comprises:

determining, according to the planned operation diagram, a turn-back train service set of all affected trains in the planned operation diagram;

acquiring an available backup rolling stock set of the depot according to the turn-back train service set and the operation data;

determining an available online rolling stock set according to the operation data and the next state of the running train;

determining whether the available backup rolling stock set of the depot and the available online rolling stock set comprise a free train in the same direction; executing a planned train service in a condition that it is determined that the available backup rolling stock set of the depot and the available online rolling stock set comprise the free train in the same direction; or in a condition that it is determined that the available backup rolling stock set of the depot and the available online rolling stock set do not comprise the free train in the same direction, determining whether the available backup rolling stock set of the depot and the available online rolling stock set comprise a free train in the opposite direction, wherein, the free train in the opposite direction is a rolling stock which meets departure time of the planned train service after turning back midway at a turn-back station as a temporary passenger train; and executing the planned train service after the temporary passenger train turns back in a condition that it is determined that the available backup rolling stock set of the depot and the available online rolling stock set comprise the free train in the opposite direction; or in a condition that it is determined that the available backup rolling stock set of the depot and the available online rolling stock set do not comprise the free train in the opposite direction, canceling the planned train service.

5. The operation adjustment method for the metro trains in the delay scenario according to claim 4, after the determining whether the available backup rolling stock set of the depot and the available online rolling stock set comprise the free train in the same direction; executing the planned train service in the condition that it is determined that the available backup rolling stock set of the depot and the available online rolling stock set comprise the free train in the same direction; or in the condition that it is determined that the available backup rolling stock set of the depot and the available online rolling stock set do not comprise the free train in the same direction, determining whether the available backup rolling stock set of the depot and the available online rolling stock set comprise the free train in the opposite direction, wherein the free train in the opposite direction is the rolling stock which meets departure time of the planned train service after turning back midway at the turn-back station as the temporary passenger train; and executing the planned train service after the temporary passenger train turns back in the condition that it is determined that the available backup rolling stock set of the depot and the available online rolling stock set comprise the free train in the opposite direction; or in the condition that it is determined that the available backup rolling stock set of the depot and the available online rolling stock set do not comprise the free train in the opposite direction, canceling the planned train service, further comprising:

determining, after traversing all train services in the turn-back train service set and allocating an executable rolling stock, whether the available online rolling stock set has a remaining rolling stock resource; and allocating the remaining rolling stock resource to a preset storage place in the metro system in a condition that it is determined that the available online rolling stock set has the remaining rolling stock resource.

* * * * *